US006909859B2

(12) United States Patent
Nakamura et al.

(10) Patent No.: US 6,909,859 B2
(45) Date of Patent: Jun. 21, 2005

(54) CHARGING APPARATUS WITH PLURAL CHARGING MEANS

(75) Inventors: Ryo Nakamura, Shizuoka (JP); Hiroyuki Suzuki, Kanagawa (JP); Ryo Inoue, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 34 days.

(21) Appl. No.: 10/429,864

(22) Filed: May 6, 2003

(65) Prior Publication Data

US 2003/0228172 A1 Dec. 11, 2003

(30) Foreign Application Priority Data

May 8, 2002 (JP) ..... 2002-133248
Jun. 25, 2002 (JP) ..... 2002-185254

(51) Int. Cl.[7] ..... G03G 15/02
(52) U.S. Cl. ..... 399/50; 399/175; 399/176
(58) Field of Search ..... 399/50, 174, 175, 399/176

(56) References Cited

U.S. PATENT DOCUMENTS 4,456,370 A * 6/1984 Hayes, Jr. ..... 399/50
5,751,405 A * 5/1998 Aita et al. ..... 399/175
5,832,336 A * 11/1998 Kawasaki et al. ..... 399/50
5,842,081 A * 11/1998 Kaname et al. ..... 399/50
5,881,343 A * 3/1999 Momotani et al. ..... 399/174
6,301,459 B1 * 10/2001 Ishiyama et al. ..... 399/175

* cited by examiner

*Primary Examiner*—William J. Royer
(74) *Attorney, Agent, or Firm*—Fitzpatrick, Cella, Harper & Scinto

(57) ABSTRACT

A charging apparatus includes plural charging devices including a first charging device and a second charging device, in which an absolute value of a current flowing from the second charging device to a member to be charged is 25% or less of an absolute value of a sum of currents respectively flowing from the plural charging devices to the member to be charged, thereby achieving uniform charging of the member to be charged.

32 Claims, 9 Drawing Sheets

FIG. 3

| C-ROLLER VOLTAGE | C-ROLLER CURRENT ( $I_1$ ) | MAGNETIC BRUSH CURRENT ( $I_2$ ) | IMAGE QUALITY | $\left\lvert \frac{I_2}{I_1+I_2} \right\rvert \times 100$ |
|---|---|---|---|---|
| NONE | — | 210 μA | △ | 100% |
| −400V | 115 μA | 90 μA | ○ | 43.9% |
| −450V | 130 μA | 75 μA | ○ | 36.6% |
| −500V | 147.5 μA | 60 μA | ○ | 28.9% |
| −550V | 162.5 μA | 45 μA | ◎ | 21.7% |
| −600V | 177.5 μA | 32.5 μA | ◎ | 15.5% |
| −650V | 190 μA | 20 μA | ◎ | 9.5% |
| −700V | 207.5 μA | 5 μA | ◎ | 2.4% |
| −750V | 225 μA | −12.5 μA | ◎ | 5.9% |
| −800V | 237.5 μA | −22.5 μA | ◎ | 10.5% |
| −850V | 252.5 μA | −37.5 μA | ◎ | 17.4% |
| −900V | 270 μA | −52.5 μA | ◎ | 24.1% |
| −950V | 287.5 μA | −67.5 μA | ○ | 30.7% |
| −1000V | 300 μA | −80 μA | ○ | 36.4% |
| −1050V | 315 μA | −92.5 μA | ○ | 41.6% |
| −1100V | 330 μA | −105 μA | ○ | 46.7% |
| −1150V | 347.5 μA | −120 μA | △ | 52.7% |
| −1200V | 362.5 μA | −132.5 μA | △ | 57.6% |

FIG. 5

| FIRST MAGNETIC BRUSH VOLTAGE | FIRST MAGNETIC BRUSH CURRENT ( $I_1$ ) | SECOND MAGNETIC BRUSH CURRENT ( $I_2$ ) | IMAGE QUALITY | $\left\lvert \frac{I_2}{I_1+I_2} \right\rvert \times 100$ |
|---|---|---|---|---|
| NONE | — | 210 μA | △ | 100% |
| −200V | 85 μA | 125 μA | △ | 59.5% |
| −250V | 100 μA | 112.5 μA | △ | 52.9% |
| −300V | 112.5 μA | 100 μA | ○ | 47.1% |
| −350V | 130 μA | 82.5 μA | ○ | 38.8% |
| −400V | 145 μA | 67.5 μA | ○ | 31.8% |
| −450V | 162.5 μA | 52.5 μA | ◎ | 24.4% |
| −500V | 177.5 μA | 37.5 μA | ◎ | 17.4% |
| −550V | 195 μA | 20 μA | ◎ | 9.3% |
| −600V | 207.5 μA | 7.5 μA | ◎ | 3.5% |
| −650V | 222.5 μA | −5 μA | ◎ | 2.3% |
| −700V | 240 μA | −22.5 μA | ◎ | 10.3% |
| −750V | 255 μA | −37.5 μA | ◎ | 17.2% |
| −800V | 270 μA | −50 μA | ◎ | 22.7% |
| −850V | 285 μA | −65 μA | ○ | 29.5% |
| −900V | 302.5 μA | −80 μA | ○ | 36.0% |
| −950V | 317.5 μA | −95 μA | ○ | 42.7% |
| −1000V | 332.5 μA | −107.5 μA | ○ | 47.8% |

CHARGING APPARATUS WITH PLURAL CHARGING MEANS

BACKGROUND OF THE INVENTION

1. Field of the Invention

The present invention relates to a charging apparatus having plural charging means which charge a member to be charged. Such charging apparatus is preferably used in an image forming apparatus for image formation by an electrophotographic process or the like, such as a copying apparatus, a printer or a facsimile machine.

2. Description of Related Art

As shown in FIG. 6, in an image forming apparatus utilizing an electrophotographic process such as a copying machine, a printer, or a facsimile, an electrophotographic photosensitive member 101 (hereinafter called a "photosensitive member") constituting an image bearing member is uniformly charged by a corona charger (charging device) 102 constituting charging means, and the surface of the charged photosensitive member 101 is subjected to an image exposure L by an exposure apparatus 103 to form an electrostatic latent image. Such electrostatic latent image is developed by a developing sleeve 104*a* of a developing apparatus 104 to form a toner image, which is transferred by a transfer roller 105 onto a transfer material P such as paper, thereby achieving formation of an image.

Also, residual toner, remaining on the surface of the photosensitive member 101 after the transfer, is removed by a cleaning blade 106, and the photosensitive member 101 is exposed to a pre-exposure lamp 107 to eliminate an optical memory of the image exposure L, thereby being prepared for a next image formation.

As a photosensitive member 101 to be employed in the aforementioned image forming apparatus, an organic photosensitive member and an amorphous silicon photosensitive member (hereinafter represented as "a-Si photosensitive member") are widely employed, and the a-Si photosensitive member is particularly employed as an electrophotographic photosensitive member for a high-speed copying machine or a laser beam printer (LBP) because it has a high surface hardness, a high sensitivity to a semiconductor laser or the like and scarce deterioration in repeated use.

For charging such a-Si photosensitive members, there are known, for example, a corona charging method utilizing a corona discharge, a roller charging method for charging by a direct discharge utilizing a conductive roller, and an injection charging method of directly injecting a charge into the surface of the photosensitive member, by securing a sufficient contact area for example with magnetic particles.

The corona charging method and the roller charging method mentioned above, utilizing a discharge, tend to cause depositing of a discharge product on the surface of the photosensitive member. In addition, as the discharge product tends to remain on the surface of the photosensitive member because the a-Si photosensitive member has a very high surface hardness and is not easily abraded, the charge on the surface of the photosensitive member bearing an electrostatic latent image moves along the surface thereof, for example by moisture adsorption under a high moisture environment, thereby resulting in an image streaking phenomenon.

On the other hand, in the aforementioned injection charging method, based on direct charge injection from a part in contact with the surface of the photosensitive member, the aforementioned image streaking phenomenon is less likely to appear.

In the a-Si photosensitive member, which is prepared by turning a gas into a plasma by a high frequency current or a microwave and depositing the gas as a solid film on an aluminum cylinder, the film thickness or the composition becomes uneven in the circumferential direction unless the plasma is generated uniformly.

Also in the image exposure of the charged photosensitive member in the exposure apparatus, a potential on the photosensitive member is attenuated (lowered) in an exposed portion (light area), and, in the a-Si photosensitive member, a potential attenuation becomes much larger even in a dark area (non-exposed portion) in comparison with an organic photosensitive member and also increases by an optical memory effect of the image exposure, so that it is preferable to provide pre-exposure means in front of the charging, in order to erase the optical memory of the preceding cycle.

For this reason, there results a very large potential attenuation, about 100 to 200 V, between a charging position and a developing position on the photosensitive member along the rotating direction thereof. In addition, because of the aforementioned unevenness in the film thickness of the a-Si photosensitive member, there results a potential unevenness of about 10 to 20 V along the circumferential direction of the photosensitive member.

In particular, the a-Si photosensitive member, having a larger electrostatic capacitance in comparison with the organic photosensitive member, is more strongly influenced by such potential unevenness, and shows an unevenness in the image density more conspicuously.

Against such drawback, it is effective to employ for example a method of charging plural times. In such method of such plural chargings against the aforementioned increase in the potential attenuation in the dark area resulting from the optical memory effect, since the optical memory can be significantly reduced in a first charging, the potential attenuation in the dark area can be reduced after a second charging. It is therefore possible to significantly alleviate a potential ghost phenomenon or a potential unevenness.

While the charging with plural injection charging devices can significantly alleviate the potential ghost phenomenon or the potential unevenness, it tends to enhance the abrasion of the surface of the photosensitive member, since a greater number of contact points with the photosensitive member are required for charge injection, for example, in case of a magnetic brush charger, since a magnetic particle carrying member is moved opposite to the moving direction of the photosensitive member to cause a frictional motion of the magnetic particles.

The a-Si photosensitive member, having a very hard surface, can provide a certain endurance even in case of using plural magnetic brush chargers, but there is desired a higher endurance because the photosensitive member is associated with a high cost because of the manufacturing process thereof. On the other hand, in case of charging the a-Si photosensitive member with a plural charging system employing corona chargers or roller chargers based on discharges, there can be obtained a high endurance against the abrasion but an image streak phenomenon tends to appear because due to depositing of a discharge product, as explained above.

Also in an a-Si photosensitive member, in order to employ plural charging means for alleviating the potential ghost phenomenon and the potential unevenness, and to achieve an improvement in the abrasion resistance and a prevention of the image streak at the same time, it is effective to combine the aforementioned injection charging method and a method of lower friction such as a corona charging method or a roller charging method.

Such combination of the injection charging method and the corona charging method or the roller charging method allows for elimination of the discharge product, generated by the corona charging or the roller charging, by the friction of the injection charger, and to maintain the abrasion of the photosensitive member almost at a level of a case of employing an injection charger only, by reducing a coating amount of the magnetic particles on the magnetic particle carrying (bearing) member, thereby decreasing the frictional force.

Also, even when employing plural magnetic brush chargers, it may be possible to realize an acceptable drum service life by reducing the coating amount of the magnetic particles, thereby decreasing the frictional force.

However, a reduction in the coating amount of the magnetic particles for decreasing the frictional force results in a decrease of the charging ability of the magnetic particle carrying member, eventually leading to a conspicuous unevenness in the charging ability. Also, other charging means, for example the roller charger, result in an unevenness in the charging ability in case toner or dust is deposited on the roller surface.

In particular, in case an unevenness in the charging ability results in the lowermost charging means (most downstream side) in the moving direction of the photosensitive member, it becomes difficult to apply a uniform charge on the surface of the photosensitive member, thereby causing a significant influence on the output image.

SUMMARY OF THE INVENTION

An object of the present invention is to provide a charging apparatus capable of uniformly charging a member to be charged.

Another object of the present invention is to provide a charging apparatus capable of preventing generation of an unevenness in the charging ability.

A further object of the present invention is to provide a charging apparatus capable of charging a member to be charged in a stable manner over a prolonged period.

A further object of the present invention is to provide a charging apparatus capable of charging a member to be charged with plural charging means.

A further object of the present invention is to provide a charging apparatus adapted for charging an amorphous silicon photosensitive member.

Still further objects of the present invention, and features thereof, will become fully apparent from the following detailed description, which is to be taken in conjunction with the accompanying drawings.

BRIEF DESCRIPTION OF THE DRAWINGS

FIG. 3 is a table showing results of evaluation on a correlation, when charging biases are applied to a magnetic brush charger and a charging roller in the first embodiment of the present invention, between currents flowing from the magnetic brush charger and the charging roller to a photosensitive member and a quality of an output image;

FIG. 5 is a table showing results of evaluation on a correlation, when charging biases are applied to magnetic brush chargers in the second embodiment of the present invention, between currents flowing from the magnetic brush chargers to a photosensitive member and a quality of an output image;

DESCRIPTION OF THE PREFERRED EMBODIMENTS

Description will now be made of preferred embodiments of the present invention, with reference to the accompanying Figures.

(Embodiment 1)

Figure 1:
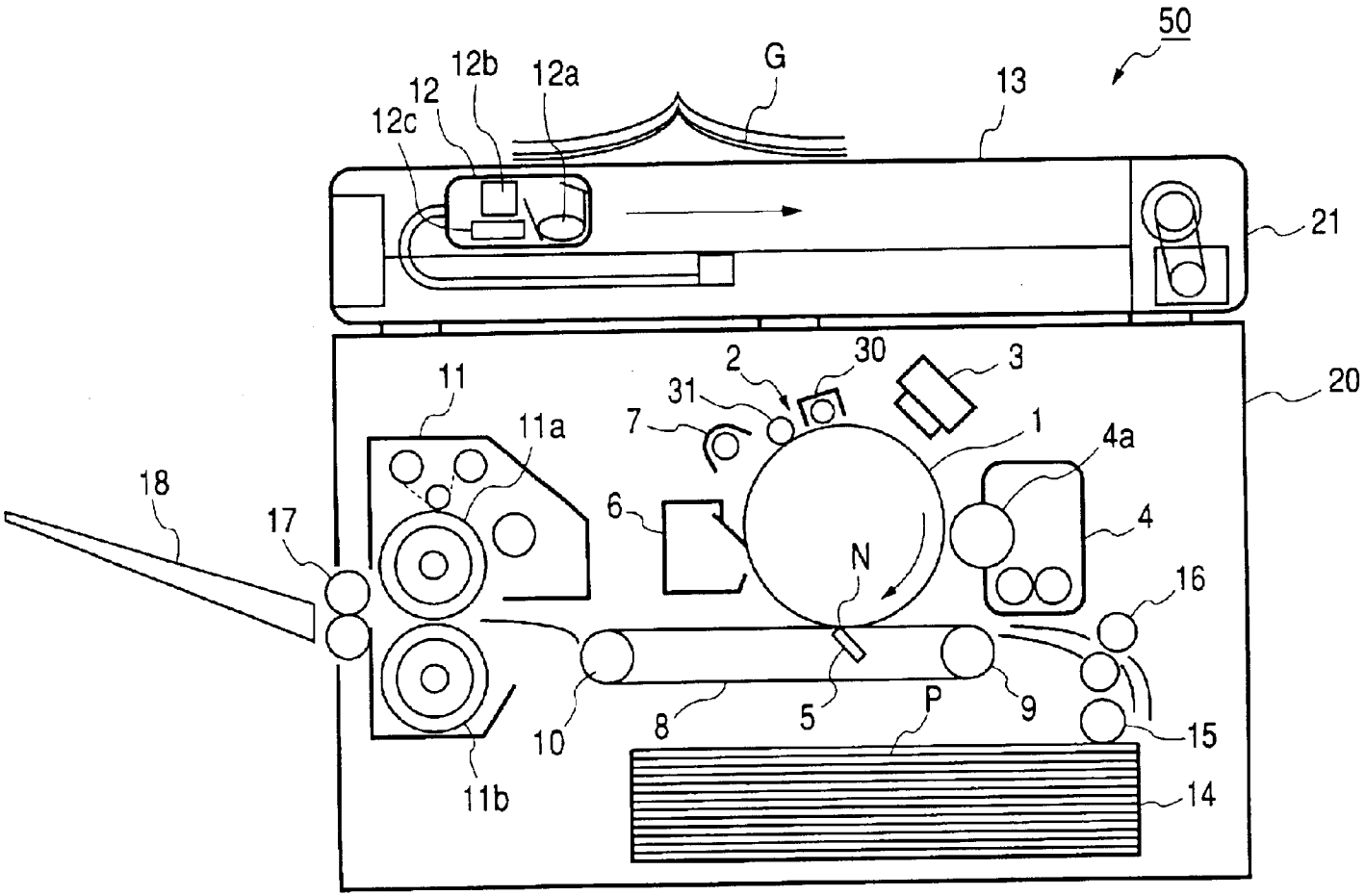
FIG. 1 is a schematic view showing the configuration of an image forming apparatus constituting first and second embodiments of the present invention.

FIG. 1 is a schematic view showing the configuration of an image forming apparatus (a copying apparatus in the present embodiment) in which a charging apparatus of a first embodiment of the present invention is used.

As shown in FIG. 1, an image forming apparatus (copying apparatus) 50 of the present embodiment includes a printer unit 20 for executing an image formation by an electrophotographic process, and a reader unit (image reading unit) 21.

The printer unit 20 is provided with a negatively chargeable photosensitive member I constituting a member to be charged (image bearing member; photosensitive drum). Around the photosensitive member 1 and along a rotating direction thereof, there are provided a charging apparatus 2, an exposure apparatus 3, a developing apparatus 4, a transfer charging blade 5, a cleaning apparatus 6 and a pre-exposure lamp 7. Also, a fixing device 11 is provided at a downstream side, i.e., in a conveying direction of a transfer material, of a transfer nip N formed between the photosensitive member 1 and the transfer charging blade 5.

In the present embodiment, the photosensitive member 1 is constituted by a negatively chargeable a-Si photosensitive member, which is rotated in a direction of an arrow (clockwise) at a predetermined peripheral speed (300 mm/sec in the present embodiment).

The charging apparatus 2 is provided with a magnetic brush charger (charging device) 30 of an injection charging method for executing a main charging, and a charging roller 31 constituting a contact charging member for executing an auxiliary charging (a detailed configuration of the magnetic brush charger 30 and the charging roller 31, featuring the present invention, and a charging bias application control of the photosensitive member 1 will be explained later).

The exposure apparatus 3 in the present embodiment is a laser beam scanner (exposure apparatus) including a laser diode (semiconductor laser), a polygon mirror, and the like, and outputs a laser light which is intensity modulated according to time-sequential electrical digital pixel signals of desired image information, thereby executing an image exposure on the uniformly charged surface of the photosensitive member 1. Such image exposure forms an electrostatic latent image corresponding to the desired image information, on the surface of the photosensitive member 1.

The developing apparatus 4 includes a developing sleeve 4*a* on which toner is coated in a thin layer. The toner, the thickness of which is regulated by a limiting blade (not shown), is supported on the surface of the developing sleeve 4*a*, and is carried by the rotation of the developing sleeve 4*a* to a developing position opposed to the surface of the photosensitive member 1.

The transfer charging blade 5 is in contact with the photosensitive member 1 in the transfer nip N across an endless transfer belt 8. The transfer charging blade 5, receiving a predetermined transfer bias, executes charging of a polarity opposite to that of the toner from the rear surface of a transfer material P, whereby a toner image on the photosensitive member 1 is transferred onto the transfer material P.

The transfer belt 8, being supported between a drive roller 9 and an idler roller 10, is rotated (moved) by the rotation of the drive roller 9, at a peripheral speed substantially equal to the rotating peripheral speed of the photosensitive member 1. The transfer material P is conveyed, while being supported on an upper belt portion of the transfer belt 8, to the transfer nip N.

The fixing device 11 is provided with a fixing roller 11*a*, incorporating a heater (not shown) and a pressure roller 11*b*, and the transfer material P conveyed to the fixing device 11 is heated and pressed in a fixing nip N between the fixing roller 11*a* and the pressure roller 11*b*, whereby the toner image is fixed to the surface of the transfer material P.

In the following, there will be explained an image forming operation by the above-described image forming apparatus 50 of the present embodiment.

When a copy start signal is entered into the image forming apparatus 50, the photosensitive member 1 is rotated by a driving apparatus (not shown) in a direction of an arrow (clockwise) at a peripheral speed of 300 mm/sec, and, after a uniform charge elimination by the pre-exposure lamp 7, the surface is uniformly charged to a predetermined negative potential by the charging roller 31 and the magnetic brush charger 30 of the charging apparatus 2 to which a charging bias is applied.

On the other hand, in the reader unit 21, an image reading unit 12 integrally formed by an original illuminating lamp 12*a*, a short-focus lens array 12*b* and a CCD sensor 12*c* is moved in a direction indicated by an arrow to illuminate and read an original G placed on an original table 13, whereby a scanning-illuminating light, reflected by the original 6, is focused by the short-focus lens array 12*b* and enters the CCD sensor 12*c*. The CCD sensor 12*c* includes a light-receiving portion, a transfer portion and an output portion of an unrepresented CCD, in which an optical signal converted by the light-receiving portion of the CCD into a charge signal, which is transferred in succession in the transfer portion in synchronization of a clock pulse to the output portion and further converted therein into a voltage signal, which is outputted after an amplification and a conversion to a lower impedance. An analog signal thus obtained is subjected to a known image processing and converted into a digital signal (image information signal) for supply to the exposure apparatus 3 of the printer unit 20.

Then the exposure apparatus 3 provides the negatively and uniformly charged photosensitive member 1 with an image exposure corresponding to the image information, and matching a reversal development process, thereby forming an electrostatic latent image. Then, toner bearing a charge is supplied from the developing sleeve 4*a* of the developing apparatus 4 onto the surface of the photosensitive member 1 in a form matching the electrostatic latent image, whereby the latent image is rendered visible as a toner image. The toner in the present embodiment is negatively charged, and the development is executed by a non-contact jumping development.

On the other hand, the transfer material P such as paper, supplied from a cassette 14 by a sheet feed roller 15, is conveyed by registration rollers 16 at a predetermined timing onto the transfer belt 8. The transfer material P, conveyed onto the transfer belt 8, is conveyed by the movement thereof to the transfer nip N, where the toner image is transferred by the transfer charging blade 5 to which there is applied a transfer bias (of opposite polarity to the toner).

The transfer material P, bearing the transferred toner image, is conveyed by the movement of the transfer belt 8 to the fixing device 11, and, after fixing the image in the fixing nip between the fixing roller 11*a* and the pressure roller 11*b* of the fixing device 11, is discharged through conveying rollers 17 to an external discharge tray 18. Residual toner, remaining on the photosensitive member 1 after the transfer, is removed and recovered by the cleaning apparatus 6.

In the following there will be given a detailed explanation of the charging roller 31 constituting first charging means and the magnetic brush charger 30 constituting second charging means in the charging apparatus 2 of the present embodiment.

Figure 2:
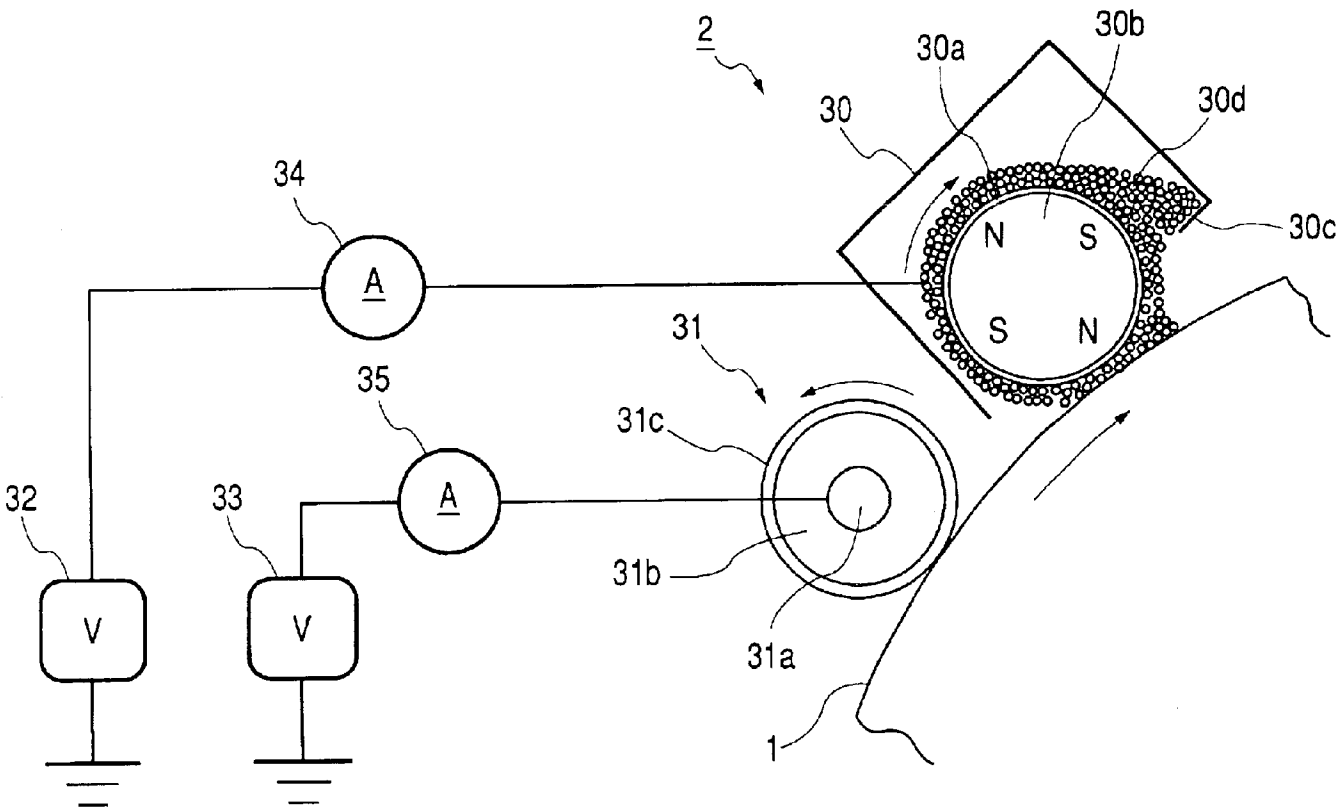
FIG. 2 is a view showing the configuration of a charging apparatus in the first embodiment of the present invention.

In the magnetic brush charger 30, as shown in FIG. 2, on a charging sleeve 30*a*, constituting a rotatable non-magnetic magnetic particle carrying member and including therein a fixed magnet roller 30*b*, conductive magnetic particles 30*d* form a brush-like structure under a magnetic field, with a thickness regulated by a magnetic particle regulating member 30*c*, and the conductive magnetic particles 30*d* are carried by the rotation of the charging sleeve 30*a*. A main charging bias source 32 is connected to the charging sleeve 30*a* and supplies a predetermined charging bias (a negative DC voltage in the present embodiment) thereto, whereby the photosensitive member 1 is given a charge from the conductive magnetic particles 30*d* and is charged to a potential approximately corresponding to the charging voltage.

The charging sleeve 30*a* is rotated in a direction indicated by an arrow (clockwise), namely in a direction opposite to that of the photosensitive member 1 in a contact position therewith, at a peripheral speed of 360 mm/sec with respect to the peripheral speed 300 mm/sec of the photosensitive member 1, whereby the surface of the photosensitive member 1 is rubbed by the conductive magnetic particles (magnetic brush layer) 30*d* with the applied charging bias and is uniformly charged at a desired potential by the injection charging method.

In the magnetic brush charger 30, it is possible to reduce the frictional force and to extend the service life of the photosensitive member 1, by reducing a gap between the magnetic particle regulating member 30*c* and the charging sleeve 30*a*, thereby decreasing the coated amount of the conductive magnetic particles 30*d* on the charging sleeve 30*a*. Also, the charging ability of the magnetic brush charger 30 is somewhat lowered by a decrease in the contact points between the conductive magnetic particles 30*d* and the photosensitive member 1, but such loss of the charging ability can be compensated by the charging of the photosensitive member 1 with the charging roller 31.

The conductive magnetic particles 30*d* preferably have an average particle size of 10 to 100 mm, a saturation magnetization of 20 to 250 emu/cm$^3$ and a resistance of $10^2$ to $10^{10}$ Ω·cm, preferably $10^6$ Ω·cm or higher in consideration of an eventual insulation defect such as a pinhole on the photosensitive member 1. Also, for improving the charging ability, there is preferred a resistance as small as possible. The conductive magnetic particles 30*d* employed in the present embodiment were formed by ferrite having a surface resistance regulated by oxidation and reduction, and had an average particle size of 25 mm, a saturation magnetization of 200 emu/cm$^3$ and a resistance of $5\times10^6$ Ω·cm.

The charging roller 31 is positioned at an upstream side of the magnetic brush charger 30, with respect to the rotating direction of the photosensitive member 1. The charging roller 31 is constituted by forming, on a conductive metal core 31*a*, an elastomer layer 31*b* and a surface layer 31*c*. Both ends of the metal core 31*a* are urged by urging members (not shown) toward the photosensitive member 1, whereby the charging roller 31 is pressed under a predetermined pressure to the surface of the photosensitive member 1 thereby forming a stripe-shaped charging nip portion with the photosensitive member 1. The charging roller 31 does not have a driving mechanism and is rotated, in a direction indicted by an arrow (counterclockwise), by the rotation of the photosensitive member 1.

The metal core 31*a* of the charging roller 31 can be composed for example of iron, aluminum or stainless steel. The elastomer layer 31*b* can be formed by a solid or foamed solid elastomer such as urethane, silicone rubber or EPDM (ethylene-propylenediene three-dimensional copolymer), to which carbon or a metal oxide such as $TiO_2$ or ZnO is added to a volume resistivity of $10^4$ to $10^{13}$. Also, the surface layer 31*c* can be formed by a film of a nylon resin such as Toresin (product name), or a synthetic resin such as polyethylene, polyester, fluorinated resin or polypropylene, which is made electrically conductive.

The surface layer 31*c* preferably has a resistance higher than that of the internal elastomer layer 31*b*. Such configuration allows to prevent a current concentration even in the presence of a pinhole on the surface of the photosensitive member 1. In the present embodiment, the charging roller 31 was constituted by forming, on an aluminum metal core 31*a*, an elastomer layer 31*b* of urethane in which carbon is dispersed for resistance adjustment, and a surface layer 31*c* of a film of nylon resin which is made electrically conductive.

An auxiliary charging bias source 33 is connected to the metal core 31*a* of the charging roller 31 and applies a predetermined charging voltage (a bias formed by superposing an AC voltage on a DC voltage) to the metal core 31*a*, whereby a charge is supplied from the charging roller 31 to the photosensitive member 1 and executes a charging thereof.

In the image forming apparatus 50 of the present embodiment, an evaluation experiment was conducted on a relationship, when charging biases were applied respectively to the magnetic brush charger 30 and the charging roller 31 of the charging apparatus 2, between currents flowing from the magnetic brush charger 30 (charging sleeve 30*a* and conductive magnetic particles 30*d*) and the charging roller 31 to the photosensitive member 1, and the image quality of an output image. In this evaluation experiment, a DC voltage of 550V was applied from the main charging bias source 32 to the charging sleeve 30*a* of the magnetic brush charger 30, while a charging bias, formed by superposing an AC voltage (fixed at a peak-to-peak voltage of 1.2 kV and a frequency of 10 kV) with a DC voltage (variable from −550V to −1200V), was applied from the auxiliary charging bias source 33 to the metal core 31*a* of the charging roller 31. As shown in FIG. 2, a current flowing in the charging sleeve 30*a* of the magnetic brush charger 30 was detected by an ammeter 34 constituting current detecting means, while a current in the metal core 31*a* of the charging roller 31 was detected by an ammeter 35 constituting current detecting means.

Obtained results are shown in FIG. 3. In this evaluation experiment, for the purpose of comparison with the present embodiment, there was also investigated a relationship between a current from the magnetic brush charger 30 to the photosensitive member 1 and the image quality of an output image, in a comparative image forming apparatus which is not provided with the charging roller 31 but with the magnetic brush charger 30 only.

In the evaluation of the image quality of the output image shown in FIG. 3, ◎ indicates a satisfactory image without unevenness, while ○ indicates a satisfactory image with limited unevenness, and Δ indicates an unsatisfactory image with conspicuous unevenness, and an evaluation level ○ or higher is considered practically acceptable.

Referring to FIG. 3, a C-roller voltage indicates a voltage applied to the charging roller 31, while a C-roller current indicates a current supplied to the charging roller 31, and a magnetic brush current (current flowing in the magnetic brush charger 30, namely current flowing from the magnetic brush charger 30 to the photosensitive member 1) has a positive or negative sign respectively when the current flow is in a forward direction or in a reverse direction with respect to the applied DC voltage. Namely, a current of a positive sign ("+" being omitted in FIG. 3) indicates a charging while a current of a negative sign indicates a charge elimination.

Also in FIG. 3, $|I2/(I1+I2)|\times100$ indicates an absolute value of a proportion of a current I2, flowing from the magnetic brush charger 30 to the photosensitive member 1, to the entire current flowing from the charging apparatus 2 to the photosensitive member 1 (namely the current in the charging roller 31 (C-roller current I1)+the current flowing from the magnetic brush charger 30 to the photosensitive member 1 (magnetic brush current I2)).

Such proportions of the currents (I1, I2) are represented by the absolute value because the current in the magnetic brush charger 30 (magnetic brush current I2) may be in a charging direction or in a charge eliminating direction, and an important factor is a small magnitude of the current flowing in the magnetic brush charger 30.

As will be apparent from the results shown in FIG. 3, extremely satisfactory output images evaluated as an image quality level ◎ in case $|I2/(I1+I2)|\times100$ was about 25 (%) or lower. In order to satisfy this relationship, it is preferred to control the voltage applied by the bias source 33 to the charging roller 31 according to the current detected by the ammeter 34. Otherwise, it is also possible to control the respective output voltages of the bias sources 32, 33 according to the currents detected by the ammeters 34, 35.

Because of the deterioration of the image quality resulting over the course of a prolonged running operation, an initial setting providing an image quality level ◎, or namely a setting where $|I2/(I1+I2)|\times100$ becomes about 25 (%) or lower is desired.

As will be apparent from the results shown in FIG. 3, when the surface of the photosensitive member 1 is charged by the charging roller 31, in a position immediately in front of the magnetic brush charger 30, to a potential approximately the same as the voltage applied to the magnetic brush charger 30, the potential on the photosensitive member 1 is further smoothed by the magnetic brush charger 30 such that unevenness in the charging can be prevented and a satisfactory image can be obtained.

This phenomenon can be explained as follows. When the potential difference between the surface potential of the photosensitive member 1 and the voltage applied to the magnetic brush charger 30 is small, a time required for charging the surface of the photosensitive member 1 to a predetermined potential is sufficiently smaller than a passing time through the charging nip portion (contact portion) between the photosensitive member 1 and the magnetic brush charger 30 whereby the surface of the photosensitive member 1 converges to the predetermined potential.

(Embodiment 2)

Figure 4:
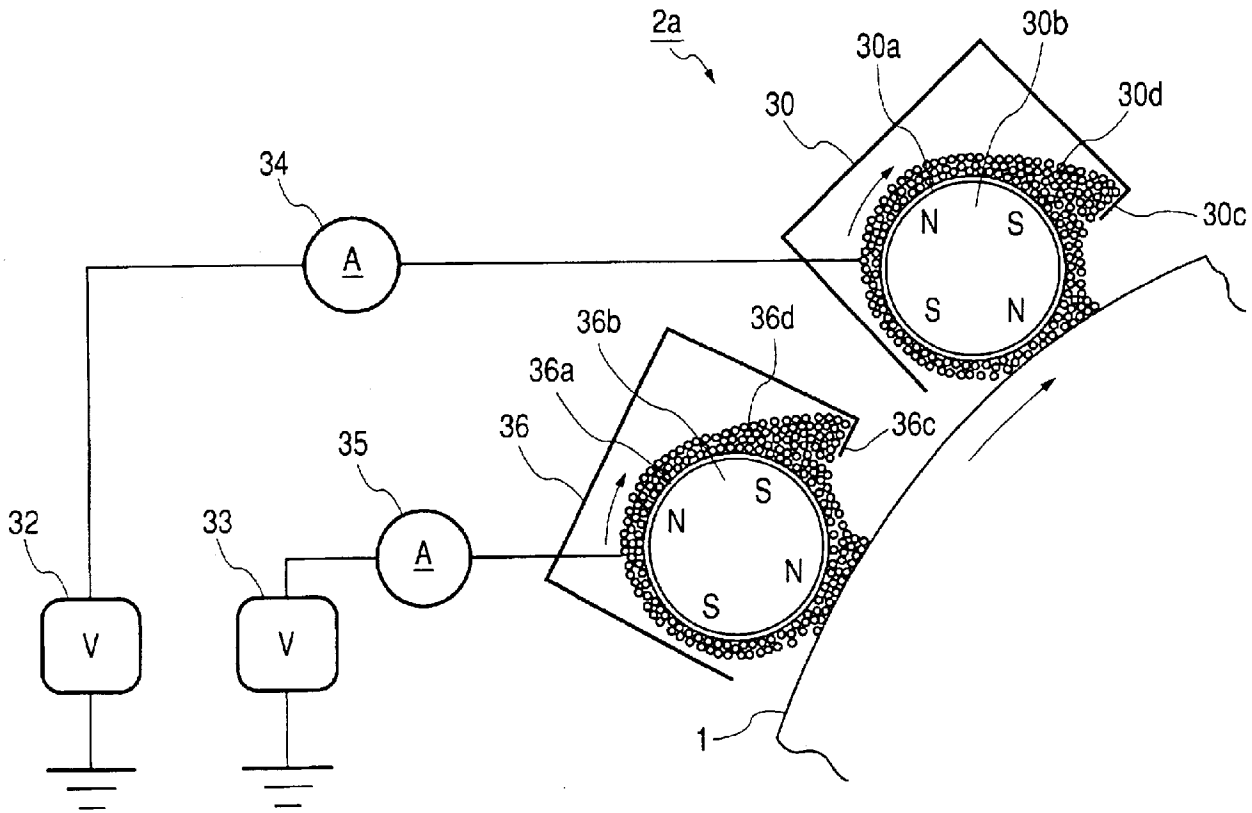
FIG. 4 is a view showing the configuration of a charging apparatus in the second embodiment of the present invention.
Figure 6:
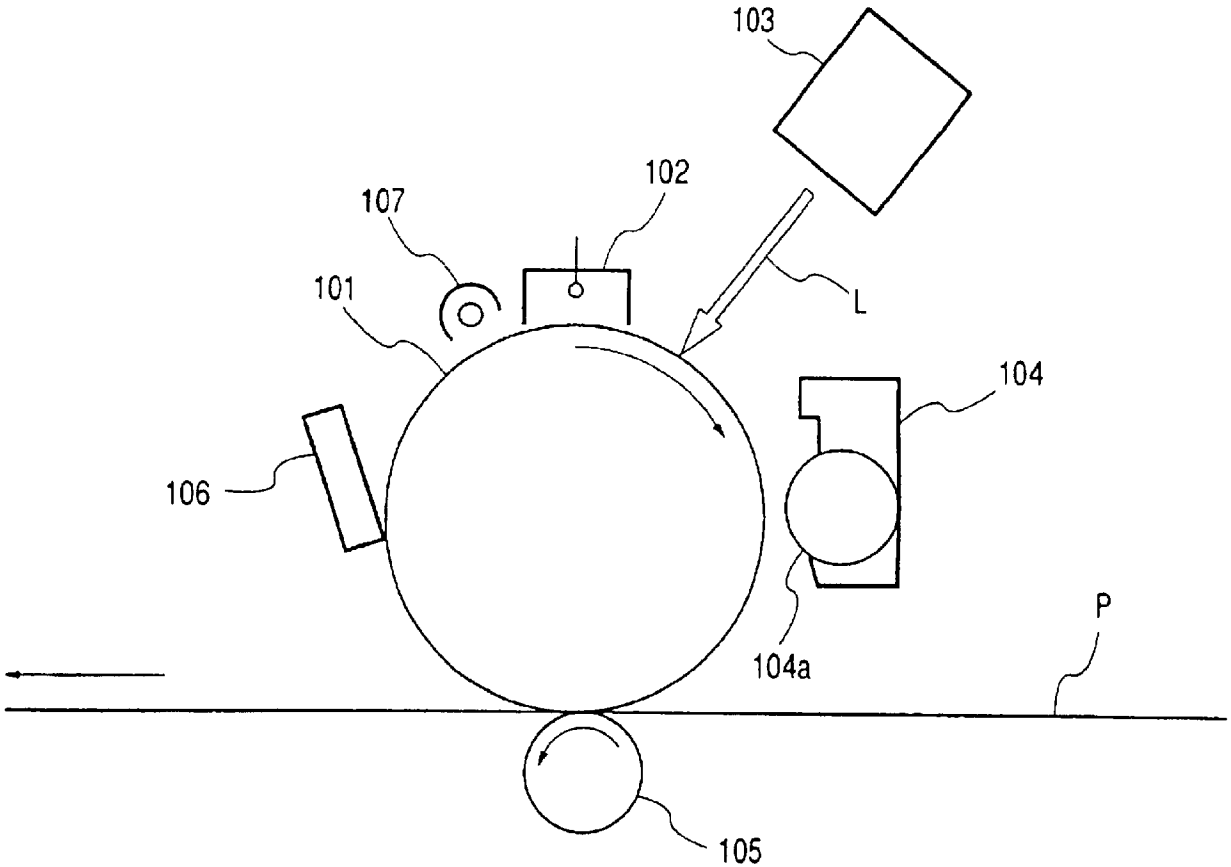
FIG. 6 PRIOR ART
FIG. 6 is a schematic view showing the configuration of a known image forming apparatus.

FIG. 4 is a schematic view showing the configuration of a charging apparatus 2*a* of an image forming apparatus constituting a second embodiment of the present invention, wherein components equivalent to those in the first embodiment, shown in FIG. 2, are represented by the same numbers, and will not be explained further. In the image forming apparatus of this embodiment, components other than the charging apparatus 2*a* are the same as those of the image forming apparatus shown in FIG. 1.

The charging apparatus 2 of the first embodiment is provided with the magnetic brush charger 30 for main charging (second charging) and the-charging roller 31 for auxiliary charging (first charging), but the charging apparatus 2*a* of the present embodiment is provided, instead of with the charging roller 31, with a magnetic brush charger 36 that uses an injection charging method as the second charging means. The magnetic brush charger 36 is positioned at the upstream side of the magnetic brush charger 30 with respect to the rotating direction of the photosensitive member 1. Other configurations are similar to those in the first embodiment.

The magnetic brush charger 36, like the magnetic brush charger 30, includes a charging sleeve 36*a*, constituting a rotatable non-magnetic magnetic particle carrying member and a fixed magnet roller 36*b*. Conductive magnetic particles 36*d* form a brush-like structure on the charging sleeve 36*a* under a magnetic field, the thickness of which is regulated by a magnetic particle regulating member 36*c*. The conductive magnetic particles 36*d* are carried by the rotation of the charging sleeve 36*a*.

An auxiliary charging bias source 33 is connected to the charging sleeve 36*a* and supplies a predetermined charging bias (a DC voltage in the present embodiment) thereto, whereby the photosensitive member 1 is given a charge from the conductive magnetic particles 36*d* and is charged to a potential approximately corresponding to the charging voltage.

The charging sleeve 36*a* is rotated, like the charging sleeve 30*a*, in a direction indicated by an arrow (clockwise), namely in a direction opposite to that of the photosensitive member 1 in a contact position therewith, at a peripheral speed of 360 mm/sec with respect to the peripheral speed 300 mm/sec of the photosensitive member 1. The surface of the photosensitive member 1 is thus rubbed by the conductive magnetic particles (magnetic brush layer) 36*d* with the applied charging bias and is uniformly charged at a desired potential by the injection charging method.

As in the first embodiment, an evaluation experiment was conducted on a relationship, when charging biases were applied respectively to the magnetic brush chargers (charging devices) 30, 36 of the charging apparatus 2*a*, between currents flowing from the magnetic brush chargers 30, 36 to the photosensitive member 1, and the image quality of an output image. The currents were measured with ammeters 34, 35. In this evaluation experiment, a DC voltage of −550V was applied from the main charging bias source 32 to the charging sleeve 30*a* of the magnetic brush charger 30, while a DC voltage (−200V to −1000V) was applied from the auxiliary charging bias source 33 to the charging sleeve 36*a* of the magnetic brush charger 36.

Obtained results are shown in FIG. 5. Also in this evaluation experiment, for the purpose of comparison with the present embodiment, a relationship between a current from the magnetic brush charger 30 to the photosensitive member 1 and the image quality of an output image was also investigated, in a comparative image forming apparatus that is not provided with the magnetic brush charger 36, but with the magnetic brush charger 30 only.

In the evaluation of the image quality of the output image shown in FIG. 5, ⊙ indicates a satisfactory image without unevenness, ○ indicates a satisfactory image with limited unevenness, and Δ indicates an unsatisfactory image with conspicuous unevenness. An evaluation level ○ or higher is considered practically acceptable.

Referring to FIG. 5, a first magnetic brush voltage and a first magnetic brush current indicate a voltage and a current I1 of the magnetic brush charger 36, respectively, and a second magnetic brush current (current of the magnetic brush charger 30) 12 to the photosensitive member 1 has a positive or negative sign respectively when the current flows in a forward direction or in a reverse direction with respect to the applied DC voltage. Namely, a current of a positive sign ("+" being omitted in FIG. 5) indicates charging while a current of a negative sign indicates charge elimination.

Also in FIG. 5, $|I2/(I1+I2)|\times 100$ indicates an absolute value of a proportion (%) of a current I2, flowing from the magnetic brush charger 30 to the photosensitive member 1, to the entire current flowing from the charging apparatus 2*a* to the photosensitive member I (namely the current in the magnetic brush charger 36 (first magnetic brush current I1)+the current flowing from the magnetic brush charger 30 to the photosensitive member 1 (second magnetic brush current I2)). Such proportions of the currents (I1, I2) are represented by the absolute value because the current in the magnetic brush charger 30 (magnetic brush current I2) may be in a charging direction or in a charge eliminating direction, and an important factor is a small magnitude of the current flowing in the magnetic brush charger 30.

As will be apparent from the results shown in FIG. 5, extremely satisfactory output images, evaluated as an image quality level ⊙, resulted when $|I2/(I1+I2)|\times 100$ was about 25 (%) or lower. In order to satisfy this relationship, it is preferred to control the voltage applied by the bias source 33 to the charging roller 31 according to the current detected by the ammeter 34. Otherwise, it is also possible to control the respective output voltages of the bias sources 32, 33 according to the currents detected by the ammeters 34, 35.

Because image quality deteriorates over the course of a prolonged running operation, an initial setting providing an image quality level ⊙, or namely a setting where $|I2/(I1+I2)|\times 100$ is about 25 (%) or lower is desired.

As will be apparent from the results shown in FIG. 5, when the surface of the photosensitive member 1, at a position immediately in front of the magnetic brush charger 30, is charged by the magnetic brush charger 36 to a potential approximately the same as the voltage applied to the magnetic brush charger 30, the potential on the photosensitive member 1 is further smoothed by the magnetic brush charger 30. Unevenness in the charging can thus be prevented, and a satisfactory image can be obtained.

This phenomenon can be explained as follows. When the potential difference between the surface potential of the photosensitive member 1 and the voltage applied to the magnetic brush charger 30 is small, a time required for charging the surface of the photosensitive member 1 to a predetermined potential is sufficiently smaller than a passing time through the charging nip portion (contact portion) between the photosensitive member 1 and the magnetic brush charger 30. The surface of the photosensitive member 1 thereby converges to the predetermined potential.

In the foregoing embodiment, DC voltages alone are applied to the magnetic brush chargers 30, 36, but an overlapping of an AC voltage shortens the time required for the surface of the photosensitive member 1 to converge to the predetermined potential, thereby being advantageous for the charging step. Also in such case, the applied charging biases can be determined, as in the foregoing embodiment, so as to minimize the DC current at the last charging.

In the foregoing first and second embodiments, as explained above, the surface of an image bearing member is charged at a uniform potential without generation of an unevenness in the charging ability, thereby providing a satisfactory image, by setting voltage applying conditions to the plural charging means in such a manner that the proportion (%) of the current flowing from the charging means positioned in the most downstream position in the moving direction of the charged member, among the plural charging means, with respect to the entire current flowing from all of the plural charging means to the charged member, becomes 25% or less.

(Embodiment 3)

Figure 7:
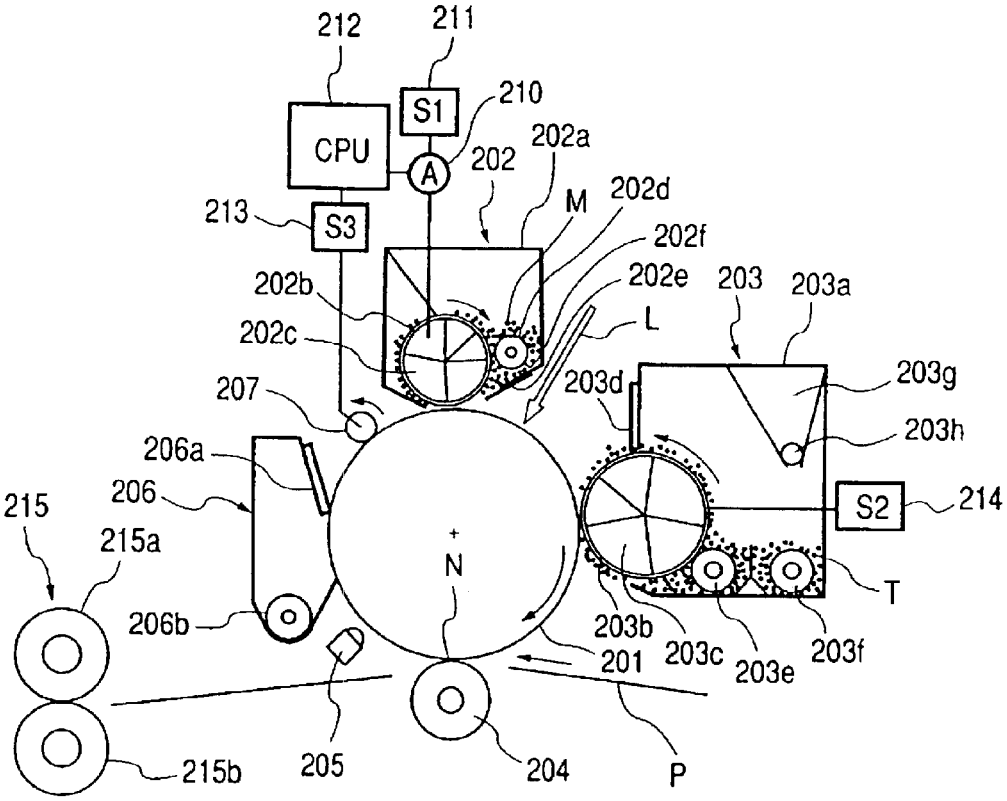
FIG. 7 is a schematic view showing the configuration of an image forming apparatus embodying the present invention.

FIG. 7 is a schematic view showing the configuration of another image forming apparatus in which the charging apparatus of the present invention is applicable. This image forming apparatus is provided with a magnetic brush charging apparatus as a main charging means (second charging means) and an auxiliary charging roller as a sub charging means (first charging means).

As shown in FIG. 7, the image forming apparatus of this embodiment is provided with a drum-shaped electrophotographic photosensitive member (hereinafter called a photosensitive drum) 201 constituting an image bearing member, and, around, and in a rotating direction of, the photosensitive drum 201, there are provided a magnetic brush charging apparatus 202 as a main charging means, a developing apparatus 203, a transfer roller 204, a charge eliminating lamp 205, a cleaning apparatus 206 and an auxiliary charging roller 207 as a sub charging means. Also, a fixing apparatus 215 is provided downstream of a transfer nip N formed between the photosensitive drum 201 and the transfer roller 204, i.e., in a conveying direction of a transfer material P.

In the present embodiment, the photosensitive drum 201 includes a negatively chargeable organic photosensitive member disposed on an aluminum cylinder of a diameter of 30 mm. A charge generation layer is formed by dispersing a diszo pigment in a resin, a charge transport layer is formed by dispersing hydrazone in a polycarbonate resin, and an organic photosensitive layer, making up an outermost (surface) charge injection layer, is formed by dispersing ultra fine $SnO_2$ particles in a photosettable acryl resin. The photosensitive member 201 is rotated by a drive mechanism (not shown) in a direction of an arrow (clockwise) at a peripheral speed of 100 mm/sec. The surface layer of the photosensitive drum 201 has a resistance of from $10^9$ to $10^{14}$ Ω·cm.

The charging apparatus 202 utilizes an injection charging method and is provided with a charging container 202*a*; a charging sleeve 202*b* constituting a rotatable contact charging member of a diameter of 30 mm and incorporating a fixed magnet roller 202*c*; conductive magnetic particles M carried on the charging sleeve 202*b* and serving to inject a charge in contact with the photosensitive drum 201; an agitating screw 202*d*; and a regulating blade 202*e* for coating the surface of the charging sleeve 202*b* with the magnetic particles M in a uniform thickness.

The charging sleeve 202*b* is positioned with a gap of 500 μm relative to the photosensitive drum 201, and is rotated in a direction indicated by an arrow (clockwise) with a peripheral speed of 150 mm/sec. A charging bias source (S1) 211 supplies the charging sleeve 202*b* with a charging bias formed by superposing an AC voltage of a peak-to-peak voltage of 500 Vpp and a frequency of I kHz with a DC voltage Vm of −600 V. The fixed magnet roller 202*c* has five magnetic pole peaks in the rotating direction (clockwise) of the charging sleeve 202*b*, constituting a repulsive pole configuration in which magnetic pole peaks of a same polarity are mutually adjacent. In the present embodiment, the fixed magnet roller 202*c* generates a magnetic flux density of $950\times10^{-4}$ T on the charging sleeve 202*b*.

The magnetic particles M are retained on the charging sleeve 202*b* by a magnetic retaining force of the fixed magnet roller 202*c*, and their thickness is regulated by the regulating blade 202*e*. An excessively low peripheral speed of the charging sleeve 202*b* results in an insufficient contact probability between the surface of the photosensitive drum 1 and the magnetic particles M, thus leading to an image defect such as an uneven charging, while an excessively high peripheral speed causes scattering of the magnetic particles M.

A peripheral speed capable of satisfactory charging, though dependent on the external diameter of the charging sleeve 202*b* and the gap between the charging sleeve 202*b* and the photosensitive drum 201, is preferably within a range of 50 to 250 mm/sec in the present embodiment.

Disposed at an upstream side of the regulating blade 202*e* in the rotating direction of the charging sleeve 202*b* is a reservoir 202*f* for the magnetic particles M. The agitating screw 202*d* agitates the magnetic particles M in the reservoir 202*f* along a generatrix of the charging sleeve 202*b*. The agitating screw 202*d* includes oval fins (not shown) mounted in alternate directions, and can agitate the magnetic particles M in the reservoir 202*f* without causing a deviation therein.

As the magnetic particles M, there can be advantageously employed any of (a) a mixture of resin and magnetic powder such as magnetite, kneaded and formed into particles, or a mixture thereof with conductive carbon or the like for resistance adjustment; (b) sintered magnetite or ferrite, or such substance of which resistance is adjusted by reduction or oxidation; and (c) the foregoing magnetic particles coated with a resistance-adjusted coating material (for example phenolic resin in which carbon is dispersed) or plated with a metal such as Ni to a suitable resistance.

The magnetic particles M, if the resistance is excessively high, are incapable of uniform charge injection into the photosensitive drum 201, thus resulting in a fogged image caused by small charging failures. On the other hand, if the resistance is excessively low, the current concentrates to a pinhole eventually present on the surface of the photosensitive drum 201, whereby the surface of the photosensitive drum 201 cannot be charged and causes a charging failure in the form of the charging nip.

Consequently, the magnetic brush charging apparatus 202 preferably has an electrical resistance of from $1\times10^4$ to $1\times10^9$ Ω, particularly of from $1\times10^4$ to $1\times10^7$ Ω. An electrical resistance of the magnetic brush charging apparatus 202 less than $1\times10^4$ Ω tends to result in a leakage through pinholes, while, with an electrical resistance exceeding $1\times10^9$ Ω, satisfactory charge injection tends to become difficult to realize. Also in order to control the resistance within the above-mentioned range, the magnetic particles M preferably have a volumic resistivity within a range of from $1\times10^4$ to $1\times10^9$ Ω·cm, more preferably from $1\times10^4$ to $1\times10^7$ Ω·cm.

The magnetic particles M employed in the present embodiment had a volume-averaged particle size of 30 mm, an apparent density of 2.0 g/cm$^3$, a resistance of $1\times10^6$ Ω, and a saturation magnetization of 58 A×m$^2$/kg. The particle size of the magnetic particles M affects the charging ability and charge uniformity. An excessively large particle size reduces the contact with the photosensitive drum 201, thus resulting in an uneven charging. On the other hand, an excessively small particle size increases the charging ability and the uniformity, but reduces the magnetic force acting on each particle, thereby enhancing sticking to the photosensitive drum 201.

Therefore, the magnetic particles M having a particle size of 5 to 100 mm can be advantageously employed. In the present embodiment, the magnetic particles M are employed in a total amount of 200 g, and are entirely gradually agitated by the agitating screw 202*d* and an agitating effect of the repulsive poles of the fixed magnet roller 202*c*.

The auxiliary charging roller 207 is positioned upstream with respect to the rotating direction of the photosensitive drum 201, of the magnetic brush charging apparatus 202. The auxiliary charging roller 207 includes a stainless steel metal core of a diameter of 6 mm, and an EPDM layer of a thickness of 3 mm in which carbon black is dispersed and which is formed by dip coating. The auxiliary charging member 207 is thus formed as a roller member having an external diameter of 12 mm with a surface layer serving as an elastic layer and a resistance controlling member.

The elastic layer of the auxiliary charging roller 207 is not limited to the foregoing but can also be composed of, for example, urethane, SBR, EVA, SBS, SEBS, SIS, TPO, EPM, NBR, IR, BR, silicone rubber or epichlorhydrine rubber, in which there may be added, if necessary, carbon black, carbon fibers, a metal oxide, metal powder, or a solid electrolyte such as a hydrogen peroxide salt or a conductivity providing material such as a surfactant.

Also, the resistance controlling member can be a resin or a rubber such as polyamide, polyurethane, fluorine, polyvinyl alcohol, silicone, NBR, EPDM, CR, IR, BR or hydrine rubber, in which a conductive or insulating filler or additive may be mixed. The above-mentioned materials may be used in any combination as long as the auxiliary charging roller 207 finally has an electrical resistance of from $1\times10^3$ to $1\times10^{10}$ Ω. The auxiliary charging roller 207 employed in the present embodiment had an electrical resistance of $1\times10^8$ Ω.

Both ends of the metal core of the auxiliary charging roller 207 are biased by biasing members (not shown) toward the photosensitive drum 201, whereby the auxiliary charging roller 207 is pressed under a predetermined pressure on the surface of the photosensitive drum 201 thereby forming a stripe-shaped charging nip portion with the photosensitive drum 201. The auxiliary charging roller 207 does not have a driving mechanism and is rotated, in a direction indicted by an arrow (counterclockwise), by the rotation of the photosensitive drum 201.

An auxiliary charging bias source (S3) 213 applies a DC voltage to the metal core of the auxiliary charging roller 207. The auxiliary charging bias source (S3) 213 is controllable by a control apparatus (CPU) 212 constituting control means, and can control a DC voltage Vs, applied to the auxiliary charging roller 207, within a range of −600 V to −2 kV.

In the developing apparatus 203, a rotatable developing sleeve 203*b*, incorporating a fixed magnet roller 203*c*, is provided at an aperture of a developing container 203*a*. A developer (toner) T contained in the developing container 203*a* is coated by a regulating blade 203*d* in a thin layer on the developing sleeve 203*b* and is carried to a developing portion opposed to the photosensitive drum 201. The developing sleeve 203*b* is rotated by a driving apparatus (not shown) in a direction indicated by an arrow (clockwise), with a peripheral speed of 150 mm/sec in the present embodiment. The developer T in the developing container 203*a* is uniformly agitated and moved toward the developing sleeve 203*b* by the rotation of agitating members 203*e*, 203*f*.

In the present embodiment, the developer T in the developing container 203*a* is a two-component developer, formed by a mixture of negatively chargeable toner of a particle size of 8 μm and positively chargeable magnetic carrier of a particle size of 50 μm, with a toner concentration of 5 wt. %. The toner concentration is controlled via detection by an optical toner concentration sensor (not shown), and is maintained constant by suitably replenishing toner from a toner hopper 203*g* into the developing container 203*a* via a feeding roller 203*h*.

In the following, there will be explained an image forming operation by the above-described image forming apparatus.

In the image forming operation, the photosensitive drum 201 is rotated by a driving apparatus (not shown) in a direction indicated by an arrow (clockwise) at a peripheral speed of 100 mm/sec. The photosensitive drum 201 is uniformly charged to a negative predetermined potential by an injection charging by the aforementioned magnetic brush charging apparatus 202. Then, an exposure L is given by a laser light (wavelength 680 nm) from an exposure apparatus (not shown) corresponding to an input image signal, whereby the potential on the photosensitive drum 201 is lowered in a portion subjected to the exposure L, thereby forming an electrostatic latent image.

The electrostatic latent image is reverse-developed by the negative developer (toner), coated as a thin layer on the developing sleeve 203*b* of the developing apparatus 203, thereby providing a visible toner image. In this operation, the developing bias source (S2) 214 supplies the developing sleeve 203*b* with a developing bias, which is formed, in the present embodiment, by superposing a DC voltage Vde of −500 V with an AC voltage of a peak-to-peak voltage of 2 kVpp and a frequency of 2 kHz.

At a timing when the toner image on the photosensitive drum 201 reaches the transfer nip N, a transfer material P such as paper is conveyed to the transfer nip N. The transfer roller 204, receiving a transfer bias of a positive polarity, i.e., opposite to that of the toner, exerts an electrostatic force, generated between the photosensitive drum 201 and the transfer roller 204, thereby transferring the toner image from the photosensitive drum 201 onto the transfer material P conveyed to the transfer nip N.

Then, the transfer material P, bearing the transferred toner image, is conveyed to the fixing apparatus 215, and, after a thermal fixation of the toner image to the transfer material P by heat and pressure in a fixing nip between a fixing roller 215*a* and a pressure roller 215*b* of the fixing apparatus 215, is discharged to the exterior.

On the other hand, the surface of the photosensitive drum 201 after the image transfer is subjected to a charge elimination by an irradiation of a charge eliminating light (central wavelength 660 nm) from a charge eliminating lamp 205, and residual toner remaining on the surface of the photosensitive drum 201 is scraped off by a cleaning blade 206*a* of the cleaning apparatus 206 and recovered into a used toner container (not shown) by the rotation of a conveying screw 206*b*.

After the removal of the residual toner, the photosensitive drum 201 is charged in advance to a predetermined negative potential by the auxiliary charging roller 207 receiving a voltage (auxiliary charging bias) from the auxiliary charging bias source (S3) 213, then enters a next image forming cycle and further charged by the magnetic brush charging apparatus 202.

In the present embodiment, the condition of voltage application to the auxiliary charging roller 207 was determined in the following manner.

At the application of the charging bias from the charging bias source (S1) 211 to the charging sleeve 202*b* of the magnetic brush charging apparatus 202, the charging current was detected by an ammeter 210, and the control apparatus (CPU) 212 controlled the voltage application to the charging sleeve 202*b* so as to minimize the charging current. As explained in the first and second embodiments, it is preferred that the detected current becomes 25% or less of the entire current.

Figure 8:
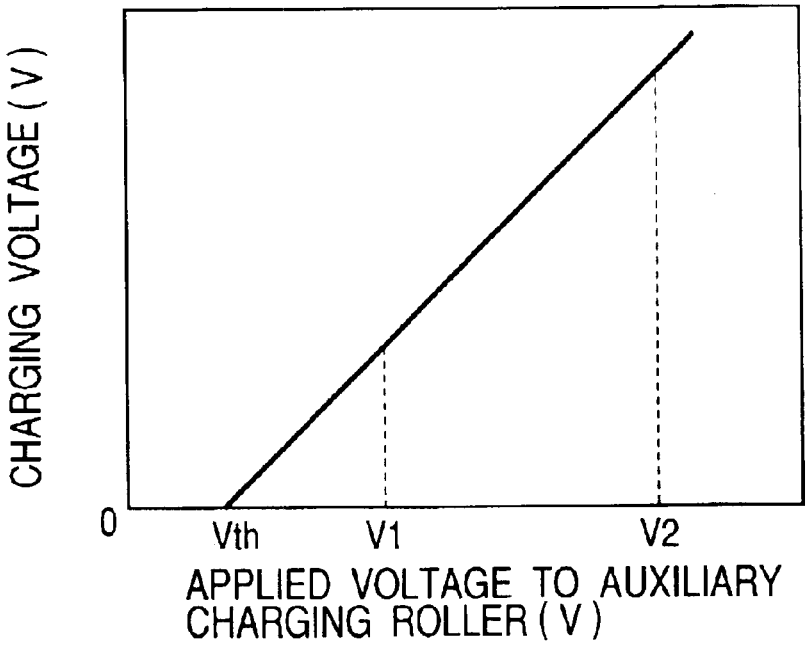
FIG. 8 is a chart showing the relationship between an applied voltage to an auxiliary charging roller (auxiliary charging roller application voltage) and a charged potential.

The auxiliary charging roller 207 employed in the present embodiment executes a corona discharge type contact charging, and the charged potential increases linearly from a discharge threshold value Vth as shown in FIG. 8, in which the abscissa indicates a voltage applied to the auxiliary charging roller 207 and the ordinate indicates a charged potential.

Therefore, there stands a relation Vd1=Vth+Vs, wherein Vd1 is a charged potential by the auxiliary charging roller 207, and Vs is a voltage applied to the auxiliary charging roller 207. Thus, there are selected two values for Vs satisfying a relation V2>V1, within the linear range of Vd1. When a DC voltage Vm is applied to the charging sleeve 202*b* of the magnetic brush charging apparatus 202, a resulting charging current Im becomes proportional to the potential of the photosensitive drum 201 immediately in front of the charging position.

Figure 9:
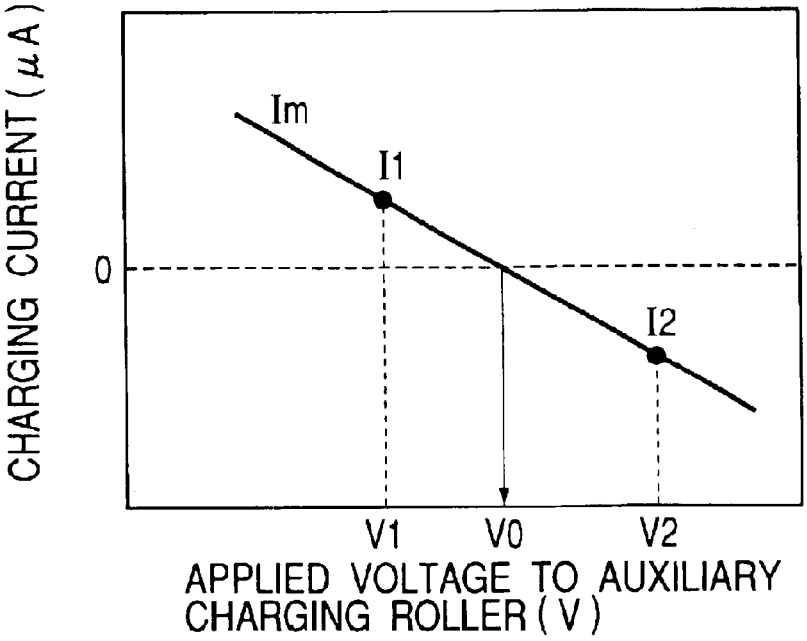
FIG. 9 is a chart showing the relationship between an applied voltage to an auxiliary charging roller (auxiliary charging roller application voltage) and a current in a charging sleeve of a magnetic brush charging apparatus.

Therefore, as shown in FIG. 9, the charging current Im can be represented by a first-order approximation to Vs, in the linear range of the charged potential Vd1. In FIG. 9, the abscissa indicates a voltage applied to the auxiliary charging roller 207, and the ordinate indicates a charging current in the charging sleeve 202*b*. These characteristics are utilized to determine the voltage applied to the auxiliary charging roller 207, so as to minimize the absolute value of the charging current Im.

More specifically, in a state where a DC voltage Vm is applied from the charging bias source 211 to the charging sleeve 202*b* of the magnetic brush charging apparatus 202, voltages V2, V1 are applied from the auxiliary charging bias source 213 to the auxiliary charging roller 207, and charging currents I1, I2 flowing in the charging sleeve 202*b* are measured with the ammeter 210.

Then, as shown in FIG. 9, an inclination of a line Im (first-order equation) passing through the charging currents I1, I2 is determined, and a value V0 is determined from a crossing point of the line Im and a line of charging current=0. Such value V0 is selected as the voltage Vs applied from the auxiliary charging bias source (S3) 213 to the auxiliary charging roller 207.

The discharge threshold Vth of the auxiliary charging roller 207 may fluctuate for example by a change in the environmental conditions, but it is desirable to select the values V2 and V1 sufficiently large so as not to be influenced by such fluctuation.

The aforementioned voltage application control to the auxiliary charging roller 207 may be conducted for every image forming cycle, or for every predetermined number of image forming cycles.

Figure 10:
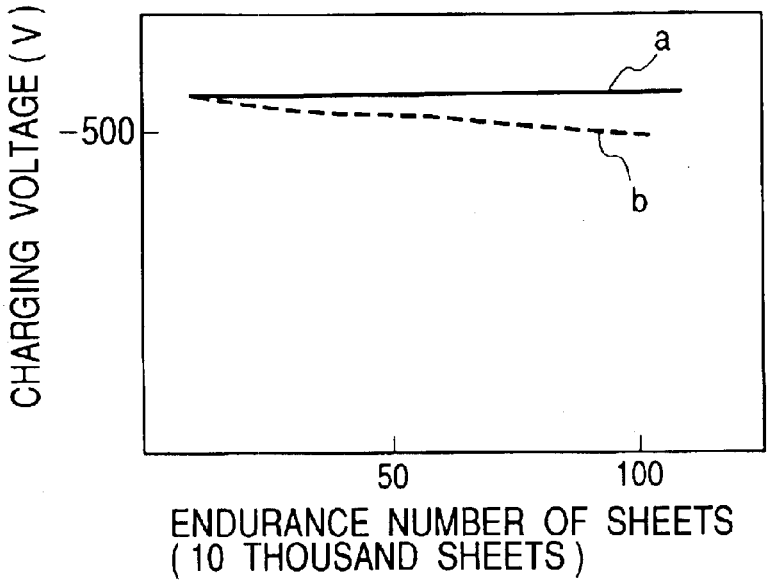
FIG. 10 is a chart showing the relationship between a charged potential and an endurance run number (output number of copies) when control of an embodiment of the invention is used.

On the image forming apparatus of the present embodiment in which the voltage determined as explained in the foregoing is applied to the auxiliary charging roller 207, an evaluation experiment was conducted on a relationship between a charged potential and an endurance run sheet number (number of image outputs). In FIG. 10, line a indicates the relationship between the charged potential and the endurance run sheet number (number of image outputs) in case of a control of the present embodiment, and line b indicates the relationship in a comparative example in which the control of the present embodiment was not adopted. In the example of the present embodiment indicated by line a in FIG. 10, the control was made at every 100 sheets. Also, the comparative example indicated by line b in FIG. 10 had the same configuration as that of the present embodiment except that a constant voltage of −1 kV was applied to the auxiliary charging roller 207.

As will be apparent from the results shown in FIG. 10, in case of the control of the present embodiment, the charge potential scarcely changed for an increase of the endurance run sheet number (number of image outputs). On the other hand, in the comparative example without control of the present embodiment, the charged potential was lowered by an increase in the resistance resulting from a deterioration of the auxiliary charging roller 207, with an increase in the endurance run sheet number (number of image outputs).

As explained in the foregoing, the present embodiment allows a stable charged potential over a prolonged period, by a control in the control apparatus 212, based on the current detected by the ammeter 210. Accordingly, the absolute value of the current flowing in the charging sleeve 202*b* of the magnetic brush charging apparatus 202 is minimized, and the condition of voltage application to the auxiliary charging roller 207 is determined.

Also, the present embodiment does not require a potential sensor for measuring the surface charged potential of the photosensitive drum 201, for each of the charging apparatuses (magnetic brush charging apparatus 202, auxiliary charging roller 207) which can restrict the positioning of various members (developing apparatus 203, cleaning apparatus 206 and the like) around the photosensitive drum 201.

The present embodiment employs the magnetic brush charging apparatus 202 as the main charging means and the auxiliary charging roller (roller charging member) 207 as the sub charging means, but such configuration is not restrictive and the present invention is likewise applicable to a case where a conductive fur brush, a conductive blade, a conductive sponge roller, and the like, are employed as the main charging means and the sub charging means.

Also, the present embodiment employs a predetermined fixed voltage applied to the magnetic brush charging apparatus 202 constituting the main charging means, but such voltage may be rendered variable according to a change in the characteristics of the photosensitive drum 201 and the developing apparatus 203.

Also, the present embodiment employs an organic photosensitive drum as the photosensitive drum 201, but such configuration is not restrictive. Alternatively, for example, a photosensitive drum having a surface layer of amorphous silicon or a photosensitive drum having a surface layer of amorphous carbon may be used.

As explained in the foregoing, the third embodiment allows a stable charged potential to be obtained over a prolonged period, thereby providing a satisfactory image, by setting a condition of voltage application from a second voltage application means to a sub charging means based on a current in a main charging means, detected by a current detecting means.

It is naturally possible to employ the first, second, and third embodiments in a suitable combination. For example the photosensitive member or the charged member in the first or second embodiments may be applied to the third embodiment, and that of the third embodiment may be applied to the first or second embodiments.

The present invention is not limited to the foregoing embodiments, but is subject to any and all modifications within the technical scope of the present invention.

What is claimed is:

1. A charging apparatus comprising:

plural charging means for charging a member to be charged, the plural charging means including first charging means and second charging means provided in a most downstream position in a moving direction of said member to be charged;

wherein an absolute value of a current flowing from the second charging means to said member to be charged is 25% or less of an absolute value of a sum of currents respectively flowing from said plural charging means to said member to be charged.

2. A charging apparatus according to claim 1, wherein said second charging means is a magnetic brush charging device including a magnetic brush in contact with said member to be charged.

3. A charging apparatus according to claim 2, wherein said magnetic brush charging device includes a rotatable magnetic particle bearing member for bearing magnetic particles.

4. A charging apparatus according to claim 2, wherein said first charging means includes a rotatable charging member provided in contact with said member to be charged.

5. A charging apparatus according to claim 4, wherein said charging member includes an elastic member.

6. A charging apparatus according to claim 2, wherein said first charging means includes a magnetic brush charging device having a magnetic brush in contact with said member to be charged.

7. A charging apparatus according to claim 1, wherein said member to be charged is an image bearing member for bearing an image.

8. A charging apparatus according to claim 7, wherein said image bearing member includes a photosensitive layer and a surface layer, and said surface layer contains a resin and conductive particles.

9. A charging apparatus according to claim 8, wherein said conductive particles include $SnO_2$.

10. A charging apparatus according to claim 7, wherein said image bearing member includes a surface layer containing amorphous silicon.

11. A charging apparatus according to claim 7, wherein said image bearing member includes a surface layer containing amorphous carbon.

12. A charging apparatus according to claim 7, wherein said image bearing member is an amorphous silicon photosensitive member.

13. A charging apparatus according to claim 7, wherein said image bearing member includes a surface layer of a resistance of $10^9$ to $10^{14}$ Ω·cm.

14. A charging apparatus according to claim 7, wherein said image bearing member is a photosensitive member, and said photosensitive member is subjected to a charge elimination by exposure means at an upstream side of said first charging means in the moving direction of said photosensitive member.

15. A charging apparatus according to claim 1, comprising detection means for detecting a current flowing in said second charging means, and voltage application means for applying a voltage to said first charging means according to the current detected by said detection means.

16. A charging apparatus according to claim 1, wherein a voltage applied to said first charging means and a voltage applied to said second charging means have a same polarity.

17. A charging apparatus comprising:

first charging means for charging a member to be charged;

second charging means that contacts said member to be charged, said second charging means being provided on a downstream side of said first charging means in a moving direction of said member to be charged;

detection means for detecting a current flowing in said second charging means; and voltage application means for applying a voltage to said first charging means according to the current detected by said detection means.

18. A charging apparatus according to claim 17, wherein said second charging means is a magnetic brush charging device including a magnetic brush in contact with said member to be charged.

19. A charging apparatus according to claim 18, wherein said magnetic brush charging device includes a rotatable magnetic particle bearing member for bearing magnetic particles.

20. A charging apparatus according to claim 18, wherein said first charging means includes a rotatable charging member provided in contact with said member to be charged.

21. A charging apparatus according to claim 20, wherein said charging member includes an elastic member.

22. A charging apparatus according to claim 18, wherein said first charging means includes a magnetic brush charging device having a magnetic brush in contact with said member to be charged.

23. A charging apparatus according to claim 17, wherein said member to be charged is an image bearing member for bearing an image.

24. A charging apparatus according to claim 23, wherein said image bearing member includes a photosensitive layer and a surface layer, and said surface layer contains a resin and conductive particles.

25. A charging apparatus according to claim 24, wherein said conductive particles include $SnO_2$.

26. A charging apparatus according to claim 23, wherein said image bearing member includes a surface layer containing amorphous silicon.

27. A charging apparatus according to claim 23, wherein said image bearing member includes a surface layer containing amorphous carbon.

28. A charging apparatus according to claim 23, wherein said image bearing member is an amorphous silicon photosensitive member.

29. A charging apparatus according to claim 23, wherein said image bearing member includes a surface layer of a resistance of $10^9$ to $10^{14}$ Ω·cm.

30. A charging apparatus according to claim 23, wherein said image bearing member is a photosensitive member, and said photosensitive member is subjected to a charge elimination by exposure means at an upstream side of said first charging means in the moving direction of said photosensitive member.

31. A charging apparatus according to claim 17, wherein a voltage applied to said first charging means and a voltage applied to said second charging means have a same polarity.

32. A charging apparatus according to claim 17, wherein said voltage is applied to said first charging means according to the current detected by said detection means, so as to minimize an absolute value of a current flowing in said first charging means.

* * * * *

UNITED STATES PATENT AND TRADEMARK OFFICE

CERTIFICATE OF CORRECTION

PATENT NO. : 6,909,859 B2
DATED : June 21, 2005
INVENTOR(S) : Ryo Nakamura et al.

It is certified that error appears in the above-identified patent and that said Letters Patent is hereby corrected as shown below:

Column 9,
Line 30, “the-charging” should read -- the charging --.

Signed and Sealed this

Twenty-fifth Day of April, 2006

JON W. DUDAS
*Director of the United States Patent and Trademark Office*